US010962193B2

(12) United States Patent
Li

(10) Patent No.: US 10,962,193 B2
(45) Date of Patent: Mar. 30, 2021

(54) VEHICLE LIGHT SYSTEM

(71) Applicant: YLX Incorporated, Shenzhen (CN)

(72) Inventor: Yi Li, Shenzhen (CN)

(73) Assignee: YLX Incorporated, Shenzhen (CN)

( * ) Notice: Subject to any disclaimer, the term of this patent is extended or adjusted under 35 U.S.C. 154(b) by 0 days.

(21) Appl. No.: 16/623,337

(22) PCT Filed: Sep. 26, 2017

(86) PCT No.: PCT/CN2017/103453
§ 371 (c)(1),
(2) Date: Apr. 27, 2020

(87) PCT Pub. No.: WO2018/227812
PCT Pub. Date: Dec. 20, 2018

(65) Prior Publication Data

US 2020/0256538 A1 Aug. 13, 2020

(30) Foreign Application Priority Data

Jun. 17, 2017 (CN) ..... 201710460342.5

(51) Int. Cl.
*F21S 43/235* (2018.01)
*F21V 9/40* (2018.01)
(Continued)

(52) U.S. Cl.
CPC ..... *F21S 43/235* (2018.01); *F21V 9/40* (2018.02); *F21V 23/003* (2013.01); *F21Y 2115/10* (2016.08)

(58) Field of Classification Search
CPC ..... F21S 43/235; F21V 9/40; F21V 23/003
(Continued)

(56) References Cited

U.S. PATENT DOCUMENTS 5,803,579 A * 9/1998 Turnbull ..... H05B 45/24 362/516
6,152,589 A * 11/2000 Kawaguchi ..... F21S 41/43 362/518
(Continued)

FOREIGN PATENT DOCUMENTS

CN 103052232 A 4/2013
CN 103576430 A 2/2014
(Continued)

OTHER PUBLICATIONS

International Search Report of corresponding PCT Application No. PCT/CN2017/103453—4 pages (dated Mar. 15, 2018).
(Continued)

*Primary Examiner* — Bryon T Gyllstrom
(74) *Attorney, Agent, or Firm* — Knobbe, Martens, Olson & Bear, LLP

(57) ABSTRACT

A vehicle light system including a light source, a spatial light modulator and a projection device; the light source includes a plurality of light-emitting modules which may be independently controlled; the spatial light modulator includes a plurality of modulation regions in one-to-one correspondence with the light-emitting modules; light emitted by a light-emitting module is incident on a modulation region corresponding thereto; each modulation region includes a plurality of light modulation units; the vehicle light system further includes a control device; according to an input signal, the control device generates a light source control signal, which is used for controlling the light output intensity of each light-emitting module of the light source, and a light modulation signal, which is used for controlling the spatial light modulator, such that the light transmission rate of at least one light modulation unit in any one of the modulation regions reaches an upper limit value.

11 Claims, 2 Drawing Sheets

(51) Int. Cl.
*F21V 23/00* (2015.01)
*F21Y 115/10* (2016.01)

(58) Field of Classification Search
USPC ..... 362/509
See application file for complete search history.

(56) References Cited

U.S. PATENT DOCUMENTS

2003/0035298 A1 2/2003 Amano
2004/0041702 A1* 3/2004 Toulmin ..... B60Q 1/2611 340/500
2004/0179367 A1* 9/2004 Takeda ..... H05B 45/37 362/466
2004/0179368 A1* 9/2004 Takeda ..... H05B 45/10 362/466
2011/0084608 A1* 4/2011 Lin ..... B60Q 3/47 315/77
2013/0208495 A1* 8/2013 Dau ..... F21V 7/0008 362/551
2015/0377446 A1* 12/2015 Bhakta ..... F21S 41/16 362/510
2019/0376653 A1* 12/2019 Dussaume ..... F21V 7/048
2020/0132277 A1* 4/2020 Akkaya ..... F21V 14/003
2020/0137324 A1* 4/2020 Akkaya ..... G01J 3/2803
2020/0236746 A1* 7/2020 Shao ..... F21V 23/003

FOREIGN PATENT DOCUMENTS

CN 104299602 A 1/2015
CN 105444124 A 3/2016
CN 105782846 A 7/2016
CN 106647214 A 5/2017

OTHER PUBLICATIONS

Chinese Office Action issued in application No. 2017104603425 dated Sep. 30, 2020.

* cited by examiner

VEHICLE LIGHT SYSTEM

CROSS REFERENCE TO RELATED APPLICATIONS

This is a U.S. National Stage Application, filed under 35 U.S.C. 371, of International Patent Application No. PCT/CN2017/103453, filed on Sep. 26, 2017, which claims priority to Chinese patent application No. 201710460342.5 filed on Jun. 17, 2017, contents of both of which are incorporated herein by reference in their entireties.

TECHNICAL FIELD

The present disclosure relates to the field of illumination, and particularly, to a vehicle light system.

BACKGROUND

Vehicles are common transportation means in daily life, but also the most common transportation means involved in traffic accidents. Studies have shown that serious traffic accidents caused during driving at night are more likely to happen than during the daytime, and an important factor of such a result is poor sight at night.

Technical Problem

In order to improve the poor vision during driving at night, it is a trend to develop high-brightness LED array light sources and laser light sources. However, only increasing brightness of the light sources of the vehicle lights is insufficient for improving the traffic conditions, and on the contrary, extremely high intensity of emergent light may cause traffic accidents. Therefore, some manufacturers have explored a new research direction of using the vehicle lights to project a pattern with a certain light distribution so as to protect visions of pedestrians and of drivers in the oncoming cars from being disturbed, and also to communicate information in some degree.

However, the vehicle light projecting the pattern with a certain light distribution means that part of light cannot be emitted and thus is remained inside the vehicle light, which causes increase in an energy consumption of the vehicle light and in heat generation and thus is unconducive to heat dissipation of the vehicle light, thereby reducing service time of the vehicle light.

Technical Solution

Regarding the prior art's defects of high energy consumption and heat generation caused by a vehicle light projecting the pattern with the certain light distribution, the present disclosure provides a vehicle light system which saves the energy and generates low heat. The vehicle light system includes a light source, a spatial light modulator, and a projection device. The light emitted by the light source is modulated by the spatial light modulator to form patterned light with a certain light distribution, and then projected by the projection device as emergent light of the vehicle light system. The light source comprises a plurality of light-emitting modules that are independently controllable. The spatial light modulator has a plurality of modulation regions corresponding to the plurality of light-emitting modules in a one-to-one correspondence, light emitted from each of the plurality of light-emitting modules is incident to a corresponding one of the modulation regions, and a plurality of light modulation units is provided in each of the plurality of modulation regions. The vehicle light system further comprises a control device, which is configured to generate, based on an input signal, a light source control signal for controlling a light output intensity of each of the plurality of light-emitting modules of the light source and a light modulation signal for controlling the spatial light modulator in such a manner that in any one of the plurality of modulation regions, a light transmission rate of at least one of the plurality of light modulation units reaches an upper limit value.

Beneficial Effects

Compared with the prior art, the present application has the following beneficial effects. In the present disclosure, a light source and a spatial light modulator of a vehicle light system are utilized to form patterned light with a certain light distribution, the light source includes a plurality of independently controllable light-emitting modules, and the light-emitting modules correspond to a plurality of modulation regions of the spatial light modulator, such that the light-emitting modules and the modulation regions form a plurality of vehicle light sub-systems, thereby improving control flexibility of the vehicle light system. The control device generates the light source control signal for controlling the light-emitting modules and the light modulation signal, and it is ensured that each modulation region includes at least one light modulation unit with the light transmission rate reaching the upper limit, thereby reducing a total light quantity provided by each light-emitting module and light "intercepted" by the spatial light modulator. In this way, the energy consumption of the vehicle light system as well as the heat generated by light that cannot be emitted both are reduced.

DETAILED DESCRIPTION OF EMBODIMENTS

The present disclosure is based on the concept that, in a first aspect, a light source of a vehicle light system is modularized and each light-emitting module corresponds to one modulation region of a spatial light modulator, such that the vehicle light system is divided into multiple "vehicle light sub-systems"; in a second aspect, according to an input signal, a light transmission rate of the spatial light modulator is maximized, and a light output power of the light-emitting module is minimized by analyzing a pre-projected light distribution pattern of each vehicle light sub-system. By combining the above two aspects, the energy consumption is reduced, and the service life is prolonged.

An extreme technical solution is not desirable. Two extreme situations, if each light-emitting module corresponds to only one light modulation unit of the spatial light modulator may cause poor projection effect, or even the spatial light modulator is omitted and a light source composed of a light-emitting unit array is directly pixelated and functioned as the spatial light modulator may cause high costs and low efficiency. Either a number of light-emitting units is too small to form a light distribution pattern with sufficient light and dark distribution details such that there are too many dark areas, which is unconducive to driver's observation; or the number of light-emitting units is such great that it is hard to reach a balance between a brightness of the light-emitting unit and a utilization, a failure rate is increased, and a volume of the light source is increased, resulting in high costs. In the present disclosure, the modularized light source and the spatial light modulator are combined to improve a resolution of emergent light, without increasing a total output power of the light source (i.e., the resolution is improved not only by increasing the number of light-emitting elements), which is more economical and practical technical solution.

The embodiments of the present disclosure are described in detail with reference to the accompanying drawings and implementations.

Figure 1:
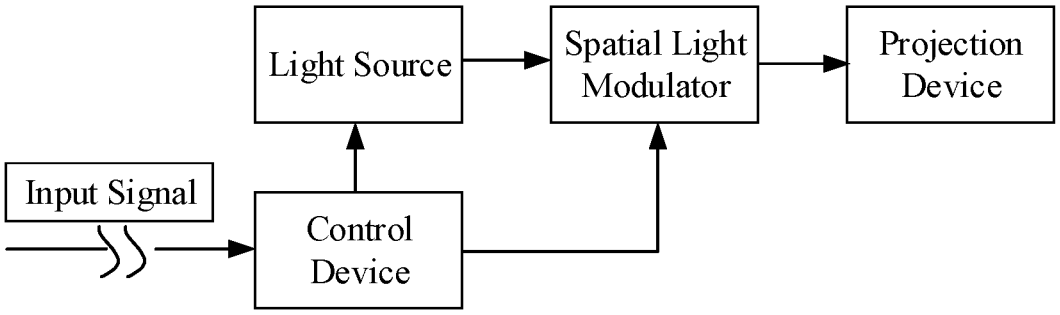
FIG. 1 is a structural block diagram of a vehicle light system according to a first embodiment of the present disclosure.
Figure 2:
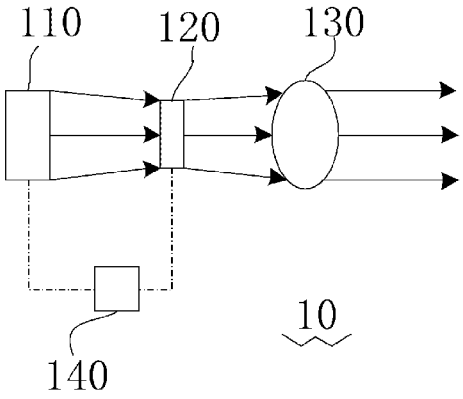
FIG. 2 is a structural schematic diagram of the vehicle light system according to the first embodiment of the present disclosure.

Referring to FIG. 1 and FIG. 2, FIG. 1 is a structural block diagram of a vehicle light system according to a first embodiment of the present disclosure, and FIG. 2 is a structural schematic diagram of the vehicle light system according to the first embodiment of the present disclosure. A vehicle light system 10 includes a light source 110, a spatial light modulator 120, a projection device 130, and a control device 140.

Light emitted by the light source 110 is modulated by the spatial light modulator 120 to form patterned light with a certain light distribution, and then is projected by the projection device 130 to be emergent light of the vehicle light system 10. The vehicle light system 10 further includes the control device 140, and the control device 140 is configured to, based on an input signal, generate a light source control signal for controlling the light source 110 and a light modulation signal for controlling the spatial light modulator 120.

Figure 3:
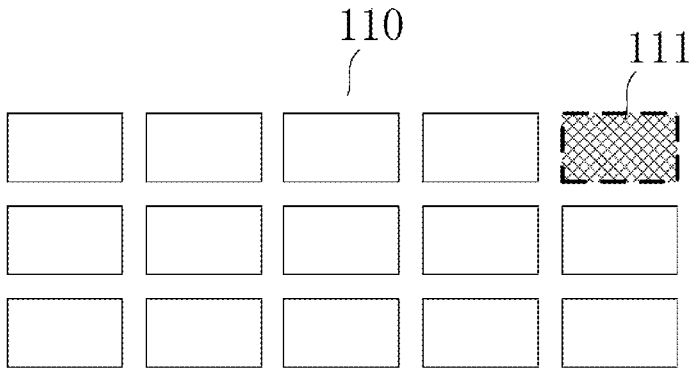
FIG. 3 is a structural schematic diagram of a light source of the vehicle light system according to the first embodiment of the present disclosure.

In the present embodiment, the light source 110 includes a plurality of independently controllable light-emitting modules. Referring to FIG. 3, which is a structural schematic diagram of the light source 110 according to the present embodiment. The light source 110 includes a plurality of independently controllable light-emitting modules. For example, including 3×5 light-emitting modules, as shown in FIG. 3, which is merely illustrative, and the number of the light-emitting modules of the light source is not limited in the present disclosure. In the present embodiment, the light source is a semiconductor light-emitting array, and each light-emitting module includes a semiconductor light-emitting unit, such as a light emitting diode (LED) or a laser diode (LD). In other embodiments, one light-emitting module may also include multiple semiconductor light-emitting units, and the multiple semiconductor light-emitting units belong to one light-emitting module are not mutually independent, but are controlled simultaneously. A light intensity of the light-emitting module is controlled by controlling voltage or current of the light-emitting module.

In another embodiment of the present disclosure, the light-emitting module includes an excitation light source and a wavelength conversion module. The excitation light source may be a laser source such as a laser diode light source or a laser diode array light source, a light emitting diode light source, or a light emitting diode array light source. The wavelength conversion module includes a wavelength conversion material (also referred to as photoluminescence material), which can absorb at least a part of light emitted by the excitation light source and emit excited light having a different wavelength from the light emitted by the excitation light source. The wavelength conversion material may be phosphor, a quantum dot, or a fluorescent ceramic, and the wavelength conversion module may be a wavelength conversion layer formed by adhering the phosphor/the quantum dot by using an adhesive, such as a fluorescent glass layer, a fluorescent resin layer, etc. The wavelength conversion module may also be the fluorescent ceramic. In the present embodiment, the excitation light source and the wavelength conversion module of each light-emitting module are mutually independent, and thus a light output intensity of the excitation light source can be controlled by independently controlling the current or voltage of the excitation light source. The intensity of light emitted by the wavelength conversion module changes with a change in the intensity of excitation light. Although the wavelength conversion modules of light-emitting modules are mutually independent with respect to the control of the emergent light, the present disclosure does not limit whether the wavelength conversion modules are structurally independent from each other. For example, in an embodiment, the wavelength conversion modules of light-emitting modules are disposed in different regions of the entire wavelength conversion device, which facilitates processing of the wavelength conversion module and also centralizes the heat dissipation.

It can be understood that the light source of the present disclosure is not limited to a semiconductor light-emitting array light source or a laser phosphor light source, and can also be any other known light source that can be modularized and can be controlled independently.

In the present embodiment, the spatial light modulator 120 has a plurality of modulation regions corresponding to the light-emitting modules of the light source 110 in a one-to-one correspondence, and light emitted by the light-emitting module is incident to one of the modulation regions corresponding to this light-emitting module. A plurality of light modulation units is provided in each modulation region in such a manner that a light spot incident to the modulation region from the light-emitting module forms small patterned light with a certain light distribution under a modulation of the modulation region. Generally, the light spot from the light-emitting module is a uniform light spot before reaching the modulation region, i.e., a monochromatic color patch pattern. That is, light incident to each light modulation unit of the modulation region is basically the same, and under a modulation of a modulation signal, the light transmission rates of the light modulation units may be different from each other, leading to different light distributions at different spatial positions, which are combined to form small patterned light in the modulation region. The small patterned light of each modulation region is spatially combined with one another, so as to form the patterned light with a certain light distribution.

Figure 4:
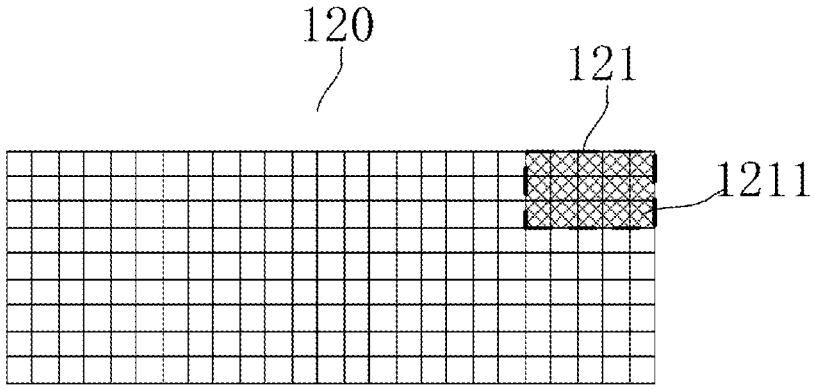
FIG. 4 is a structural schematic diagram of a spatial light modulator of the vehicle light system according to the first embodiment of the present disclosure.

Referring to FIG. 4, which is a structural schematic diagram of the spatial light modulator 120 in the present embodiment. The spatial light modulator 120 has 3×5 modulation regions corresponding to the light-emitting modules of the light source 110 in a one-to-one correspondence, and 3×5 light modulation units are provided in each modulation region. The number of the light modulation units is illustrative, and is not specifically limited in present disclosure. As shown in FIG. 3 and FIG. 4, one light-emitting module 111 (in the rectangular dotted frame) of the light source 110 corresponds to one modulation region 121 (in the rectangular dotted frame) of the spatial light modulator 120. The light modulation unit 1211 and 14 other light modulation units are provided in the modulation region 121.

In the present embodiment, the control device 140 generates the light source control signal and the light modulation signal based on the input signal. The light source control signal is configured to control light output intensity of each light-emitting module of the light source, and the light modulation signal is configured to control each light modulation unit of the spatial light modulator. By simultaneously changing the light output intensity of the light-emitting module and the light modulation signal of the spatial light modulator, the light transmission rate of at least one light modulation unit in any one of modulation regions reaches an upper limit value.

In the present embodiment, the input signal includes light distribution image data, and the control device divides the light distribution image data into pieces of sub-image data corresponding to the light-emitting modules in a one-to-one correspondence. For each piece of sub-image data, the control device obtains a maximum pixel brightness value, and then calculates a ratio of the maximum pixel brightness value to the upper limit value of pixel brightness.

For example, in one piece of sub-image data containing 3×5 pixels, a pixel located at the second row and the third column has the maximum pixel brightness value. If a display brightness of each pixel is in a range of 0 to 16, an upper limit value of pixel brightness is 16. The brightness value of the pixel located at the second row and the third column is 8, the calculated ratio of the maximum pixel brightness value to the upper limit value of pixel brightness is 1/2. When the light-emitting module outputs at a rated power, the light modulation unit corresponding to the pixel located at the second row and the third column should be set to have a light transmission rate of 50% so as to display an image correctly, i.e., 50% of light is absorbed or reflected and thus is wasted inside the vehicle light system through heat dissipation, which not only wastes energy, but also generates excessive waste heat. The light modulation units corresponding to other pixels with lower pixel brightness values may have lower light transmission rates and generate more heat. Therefore, the only way to reduce energy consumption and heat generation of the vehicle light system is to increase the light transmission rates of the light modulation units, i.e., to reduce the light that is absorbed or reflected after being blocked by the light modulation units. Therefore, by controlling the light modulation signal of the spatial light modulator in the present disclosure, the light transmission rate of at least one light modulation unit in each modulation region reaches the upper limit value, that is, as close as possible to 100% of the light transmission rate. As optical loss is unavoidable during propagation in the medium or during reflection at an interface, it is impossible to reach 100% of the light transmission rate, and the upper limit value herein refers to a maximum light transmission rate considering the unavoidable optical loss.

Since the light transmission rate of the light modulation unit in the light modulation region may change under the control of the control device, the output power of each light-emitting module is also required to change accordingly, in order to ensure an unchanged light output effect of the light emitted by the vehicle light system. The control device obtains the light source control signal of a corresponding light-emitting module according to the ratio of the maximum pixel brightness value in one piece of sub-image data to the upper limit value of pixel brightness. Under the light source control signal, the light output intensity of the light-emitting module is a product of rated light output intensity and the ratio. The light source control signal can be either a current control signal or a voltage control signal of the light source. As mentioned in the above example, if the light transmission rate of the light modulation unit corresponding to the pixel in the second row and the third column is set to be 100%, the light output intensity of the light-emitting module is reduced by 50%, accordingly. It should be noted that a linear relationship between the light output intensity and the current of the light-emitting module is unnecessary, especially for the above light source for exciting the phosphor. In this case, it is required to provide a memory connected to the control device, in order to store a table of the relationships between the light output intensity and the current (or voltage) of the light-emitting module. The light source control signal for controlling the light-emitting module can be obtained in accordance with the table.

In order to ensure that a light quantity of the light modulation unit corresponding to the pixel with the maximum pixel brightness value in one piece of sub-image data reaches an upper limit value, a grayscale value of this pixel is necessarily set to be an upper limit of grayscale value. In this embodiment, through a data operation of the control device, the grayscale value of each pixel in each piece of the sub-image data is proportionally amplified until a maximum grayscale value of a pixel in the piece of the sub-image data reaches the upper limit, and this piece of the sub-image data is converted to a new piece of sub-image data. The control device generates, based on the new piece of sub-image data, a light modulation signal for modulating grayscale values, and transmits the light modulation signal for modulating grayscale values to the spatial light modulator. In this technical solution, the output light distribution of the vehicle light system can still have a preset effect even after the output power of each light-emitting module is changed, so as to avoid a disordered image brightness distribution.

In an embodiment of the present disclosure, the spatial light modulator is a digital micromirror device including multiple micromirrors as light modulation units, several micromirrors form one modulation region, and the light modulation unit control the light transmission rate by controlling a ratio of a time duration in which the micromirror in a switch-on state to a time duration in which the micromirror in a switch-off state. When the micromirror is in the switch-on state, the light from the light-emitting module is projected by the projection device after being reflected. When the micromirror is in the switch-off state, the light from the light-emitting module is completely absorbed in the vehicle light system after being reflected. The light transmission rate of the light modulation unit is a ratio of a time duration in which the light modulation unit is kept in the switch-on state during an operating period of the light modulation signal to the operating period of the light modulation signal.

In another embodiment of the present disclosure, the spatial light modulator is a liquid crystal device including multiple liquid crystal units as light modulation units, several liquid crystal units form one modulation region, and the liquid crystal unit control the light transmission rate by controlling a light transmissivity. The light transmission rate of the modulation unit is a light transmissivity of the light modulation unit.

In the present embodiment, the input signal includes light distribution image data information, and the control device generates the light source control signal for controlling each light-emitting module and the light modulation signal for controlling the spatial light modulator after processing the light distribution image data information.

The input signal can be an active input signal or a passive input signal. In an embodiment, the input signal is the active input signal, which is an operation instruction from a driver. For example, if the driver wants to project a pattern in a certain shape on the ground in front of or behind the vehicle for warning the surrounding vehicles or pedestrians, so as to improve the driving safety, such as icons indicating left- or right-turning, the driver can issue instructions by operating mechanical structures such as buttons, knobs, etc., or using intelligent recognition systems such as voice recognition or gesture recognition. According to the instructions, relevant devices in the vehicle generate a corresponding image information signal, such as image data that can display the light and dark distribution of specific icons, and the image information signal is transmitted to the control device, so as to project a preset image by the projection device under the effects of the light source and the spatial light modulator.

In another embodiment, the input signal is the passive input signal, which is generated by a vehicle collecting external information and is provided to the control device. The external information may include current road condition information, such as road pits, bumps, road bifurcation/convergence, etc., and may also include obstacle information, such as pedestrians, pets, other vehicles, stones, etc. By analyzing the collected information, image data of a specific light distribution are generated, so that the light projected by the vehicle light system can avoid pedestrians, vehicles, or clearly indicated obstacles. In this embodiment, the vehicle light system further includes a detection device configured to collect the external information mentioned above. The detection device may be at least one of an infrared detection device, a sound wave detection device, a temperature detection device, or a visible light camera device. Although the detection device may collect various initial data information, all the initial data information, after subjected to data processing, is input to the control device in the form of image data that the control device can recognize.

The embodiments in the present disclosure are described in a progressive manner. Each embodiment emphasizes the differences from other embodiments. The same or similar parts of the embodiments can be referred to each other.

The above-described embodiments are not all embodiments of the present disclosure, and are also not intended to limit the scope of the present disclosure. Any equivalent structures or equivalent process modifications made on basis of the description and drawings of the present disclosure, or directly or indirectly applied to other related technical fields shall fall into the protection scope of the present disclosure.

What is claimed is:

1. A vehicle light system, comprising a light source, a spatial light modulator, a projection device, and a control device, wherein light emitted by the light source is modulated by the spatial light modulator to form patterned light with a certain light distribution, and then projected by the projection device as emergent light of the vehicle light system;

wherein the light source comprises a plurality of light-emitting modules that are independently controllable;

wherein the spatial light modulator has a plurality of modulation regions corresponding to the plurality of light-emitting modules in a one-to-one correspondence, light emitted from each of the plurality of light-emitting modules is incident to a corresponding one of the plurality of modulation regions, and each of the plurality of modulation regions has a plurality of light modulation units; and wherein the control device is configured to generate, based on an input signal, a light source control signal for controlling a light output intensity of each of the plurality of light-emitting modules of the light source and a light modulation signal for controlling the spatial light modulator, such that in any one of the plurality of modulation regions, a light transmission rate of at least one of the plurality of light modulation units reaches an upper limit value.

2. The vehicle light system according to claim 1, wherein the input signal comprises light distribution image data which comprises pieces of sub-image data corresponding to the plurality of light-emitting modules in a one-to-one correspondence; and wherein the control device is configured to: obtain a maximum pixel brightness value in each of the pieces of sub-image data, calculate a ratio of the maximum pixel brightness value to an upper limit value of pixel brightness, and obtain a light source control signal for one of the plurality of light-emitting modules corresponding to the piece of sub-image data based on the ratio.

3. The vehicle light system according to claim 2, wherein the control device is configured to amplify a grayscale value of each pixel in one of the pieces of sub-image data in equal proportion to obtain a new piece of sub-image data in such a manner that a grayscale value of a pixel having a maximum pixel brightness value in the new piece of sub-image data reaches an upper limit of grayscale value, and the control device is further configured to generate a light modulation signal based on the new piece of sub-image data.

4. The vehicle light system according to claim 1, wherein the light source is a semiconductor light-emitting array, and each of the plurality of light-emitting modules comprises at least one semiconductor light-emitting unit.

5. The vehicle light system according to claim 1, wherein each of the plurality of light-emitting modules comprises an excitation light source and a wavelength conversion module.

6. The vehicle light system according to claim 5, wherein each of the wavelength conversion modules of the plurality of light-emitting modules is disposed in a different region of a wavelength conversion device.

7. The vehicle light system according to claim 1, wherein the spatial light modulator is a digital micromirror device, and a light transmission rate of each of the plurality of modulation units is a ratio of a time duration in which the light modulation unit is in a switch-on state during an operating period of the light modulation signal to the operating period of the light modulation signal.

8. The vehicle light system according to claim 1, wherein the input signal is an active input signal, and the active input signal is an operation instruction from a driver.

9. The vehicle light system according to claim 1, wherein the input signal is a passive input signal, and the passive input signal is external information collected by a vehicle and comprises at least road condition information or obstacle information.

10. The vehicle light system according to claim 9, wherein the vehicle light system further comprises a detection device configured to collect the external information and comprises at least one of an infrared detection device, a sound wave detection device, a temperature detection device, or a visible light camera device.

11. The vehicle light system according to claim 1, wherein the spatial light modulator is a liquid crystal device, and a light transmission rate of each of the plurality of modulation units is a light transmittance of the light modulation unit.

* * * * *